US011210937B2

(12) United States Patent
Malhan et al.

(10) Patent No.: US 11,210,937 B2
(45) Date of Patent: Dec. 28, 2021

(54) METHOD FOR UN-SIGNALIZED INTERSECTION TRAFFIC FLOW MANAGEMENT

(71) Applicant: DENSO International America, Inc., Southfield, MI (US)

(72) Inventors: Rajesh Malhan, Troy, MI (US); Joseph Lull, South Haven, MI (US)

(73) Assignee: DENSO INTERNATIONAL AMERICA, INC., Southfield, MI (US)

( * ) Notice: Subject to any disclaimer, the term of this patent is extended or adjusted under 35 U.S.C. 154(b) by 219 days.

(21) Appl. No.: 16/525,800

(22) Filed: Jul. 30, 2019

(65) Prior Publication Data

US 2020/0320869 A1 Oct. 8, 2020

Related U.S. Application Data

(60) Provisional application No. 62/829,057, filed on Apr. 4, 2019.

(51) Int. Cl.
*G08G 1/01* (2006.01)
*G08G 1/07* (2006.01)

(52) U.S. Cl.
CPC ..... *G08G 1/0145* (2013.01); *G08G 1/07* (2013.01)

(58) Field of Classification Search
CPC .. G08G 1/0145; G08G 1/07; G08G 1/096741; G08G 1/095; G08G 1/096775; G08G 1/0112; G08G 1/0116
See application file for complete search history.

(56) References Cited

U.S. PATENT DOCUMENTS

| | | | | |
|---|---|---|---|---|
| 4,361,202 | A | 11/1982 | Minovitch | |
| 7,860,639 | B2 | 12/2010 | Yang | |
| 7,970,530 | B2 | 6/2011 | Desai et al. | |
| 10,013,878 | B2 | 7/2018 | Ricci et al. | |
| 10,176,712 | B1 * | 1/2019 | Martins | G08G 1/07 |
| 2018/0111611 | A1 | 4/2018 | MacNeille et al. | |
| 2020/0211379 | A1 * | 7/2020 | Quijano | H04W 4/80 |

FOREIGN PATENT DOCUMENTS

| | | |
|---|---|---|
| CN | 101736663 | 5/2011 |
| CN | 102201164 | 9/2015 |
| CN | 104428826 | 5/2017 |
| ES | 2274719 | 5/2008 |
| ES | 1074686 | 5/2011 |
| FR | 2426299 | 12/1979 |

* cited by examiner

*Primary Examiner* — Quan-Zhen Wang
*Assistant Examiner* — Rajsheed O Black-Childress
(74) *Attorney, Agent, or Firm* — Burris Law, PLLC

(57) ABSTRACT

The present disclosure is directed toward a method that includes acquiring current dynamic characteristics of a moving object about an un-signalized intersection, determining a dynamic traffic flow of the un-signalized intersection based on the current dynamic characteristics to determine a position of the moving object about the un-signalized intersection, and predicting future dynamic characteristics of the moving object based on the dynamic traffic flow and a predictive control. The future dynamic characteristics includes a predicted position of the moving object at a predefined time in the future. The method further calculates an entry parameter for a vehicle about an entrance of the un-signalized intersection based on the dynamic traffic flow and the predicted future dynamic characteristics and notifies the vehicle of the entry parameter.

20 Claims, 7 Drawing Sheets

METHOD FOR UN-SIGNALIZED INTERSECTION TRAFFIC FLOW MANAGEMENT

CROSS-REFERENCE TO RELATED APPLICATIONS

This application claims priority to and the benefit of U.S. Provisional Application No. 62/829,057 filed on Apr. 4, 2019. The disclosure of the above application is incorporated herein by reference.

FIELD

The present disclosure relates to regulating traffic flow at un-signalized intersections.

BACKGROUND

The statements in this section merely provide background information related to the present disclosure and may not constitute prior art.

Traffic intersections without traffic lights or signage (i.e., un-signalized intersection) can be difficult to navigate as road users may be competing to enter the intersection. One example of an un-signalized intersection is a roundabout that generally promotes smoother, continuous traffic flow at lower speed, which can decrease the impact of an accident should an incident occur. Generally, a roundabout has fewer conflict points than that of conventional intersections. For example, a single lane roundabout can have 8 conflict points, whereas a two-lane bidirectional flow intersection can have 32 conflict points.

However, like conventional un-signalized intersections, road users are competing to enter and traverse the roundabout. In addition, low and inconsistent speed of vehicles traversing the roundabout can cause congestion and is a common issue with roundabouts. These and other issues are addressed by the present disclosure.

SUMMARY

This section provides a general summary of the disclosure and is not a comprehensive disclosure of its full scope or all of its features.

In one form, the present disclosure is directed toward a method that includes: acquiring current dynamic characteristics of a moving object about an un-signalized intersection; determining a dynamic traffic flow of the un-signalized intersection based on the current dynamic characteristics; predicting future dynamic characteristics of the moving object based on the dynamic traffic flow and a predictive control, where the future dynamic characteristics includes predicted characteristics of the moving object at a predefined time in the future; calculating an entry parameter for a vehicle about an entrance of the un-signalized intersection based on the dynamic traffic flow, the predicted future dynamic characteristics; and notifying the vehicle of the entry parameter.

In one form, the present disclosure is directed toward an intersection control system that includes a controller configured to: acquire current dynamic characteristics of a moving object about an un-signalized intersection; determine a dynamic traffic flow of the un-signalized intersection based on the current dynamic characteristics; predict future dynamic characteristics of the moving object based on the dynamic traffic flow and a predictive control, where the future dynamic characteristics includes predicted characteristics of the moving object at a predefined time in the future; calculate an entry parameter for a vehicle about an entrance of the un-signalized intersection based on the dynamic traffic flow and the future dynamic characteristics; and notify the vehicle of the entry parameter.

In one form, the present disclosure is directed toward an intersection control system that includes a plurality of intersection sensors configured to monitor environment about an un-signalized intersection, a communication device configured to exchange data with external devices and received data indicative of characteristics of a moving object, and a controller. The controller is configured to: acquire current dynamic characteristics of the moving object about the un-signalized intersection based on the received data, where the current dynamic characteristics includes a current position, a current speed, a current direction, or a combination thereof of the moving object; determine a dynamic traffic flow of the un-signalized intersection based on the current dynamic characteristics; predict future dynamic characteristics of the moving object based on the dynamic traffic flow and a predictive control, where the future dynamic characteristics includes a predicted speed, a predicted travel direction, a predicted position, or a combination thereof of the moving object at a predefined time in the future; calculate an entry parameter for a vehicle about an entrance of the un-signalized intersection based on the dynamic traffic flow and the future dynamic characteristics; and notify the vehicle of the entry parameter.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
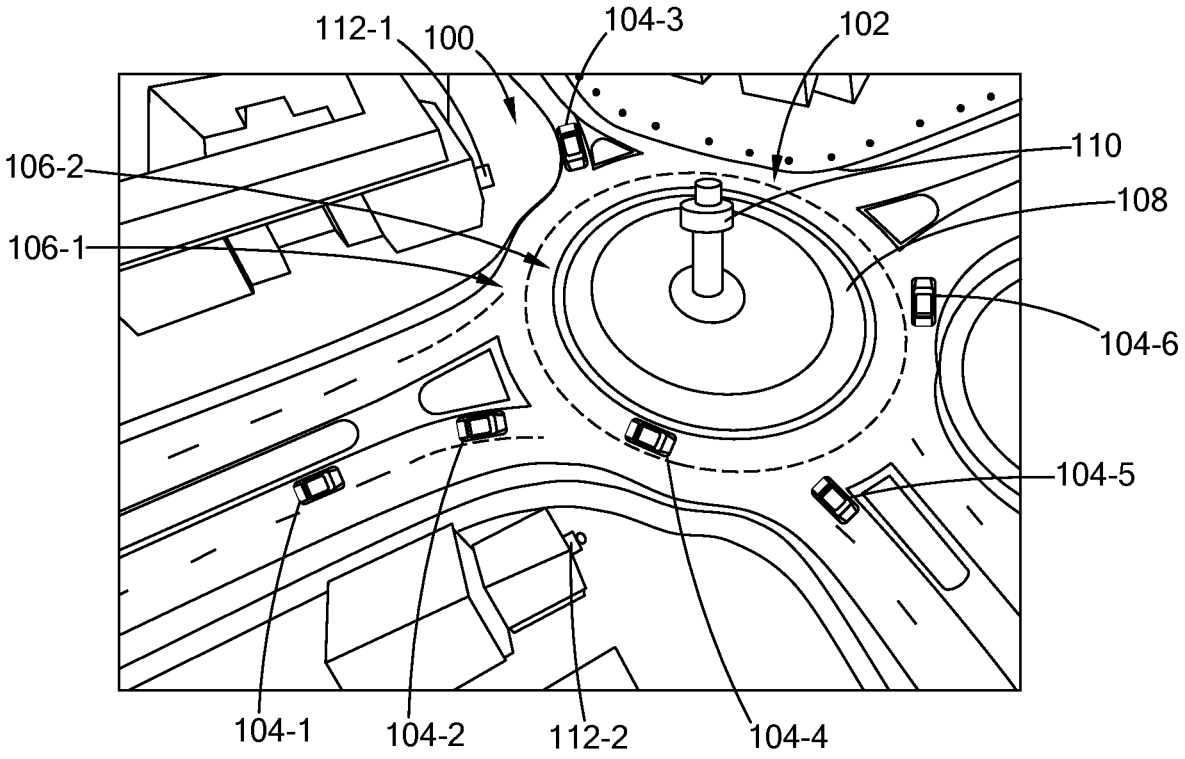
FIG. 1 illustrates a system having a roundabout and multiple vehicles in accordance with the teachings of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure describes an intersection control system for controlling the traffic flow through an un-signalized intersection. The intersection control system may improve traffic flow, efficiency, and safety by regulating the entry of vehicles through the un-signalized intersection by real-time analysis of dynamic characteristics of moving objects about the intersection which may include moving objects at, approaching, and/or exiting the intersection. While the intersection control system is described with respect a roundabout as the un-signalized intersection, the intersection control system can be configured to control traffic through other types of un-signalized intersections.

In the following, dynamic characteristics includes characteristics of a moving object provided about the un-signalized intersection to define the behavior of the moving object and includes, but is not limited to, vehicles, pedestrians, and/or cyclists. Based on the type of moving object, the dynamic characteristics may include, but is not limited to, location, speed, distance, travel direction, travel path about the un-signalized intersection, and/or acceleration. In one form, the dynamic characteristics for a given object can be provided by the moving object such as a vehicle transmitting a message and/or determined using data from sensors, moving objects, roadside unit, and/or other devices. For example, multiple data points indicative of a position of a moving object within a time period can be used to determine the speed and travel direction of the moving object.

Figure 2:
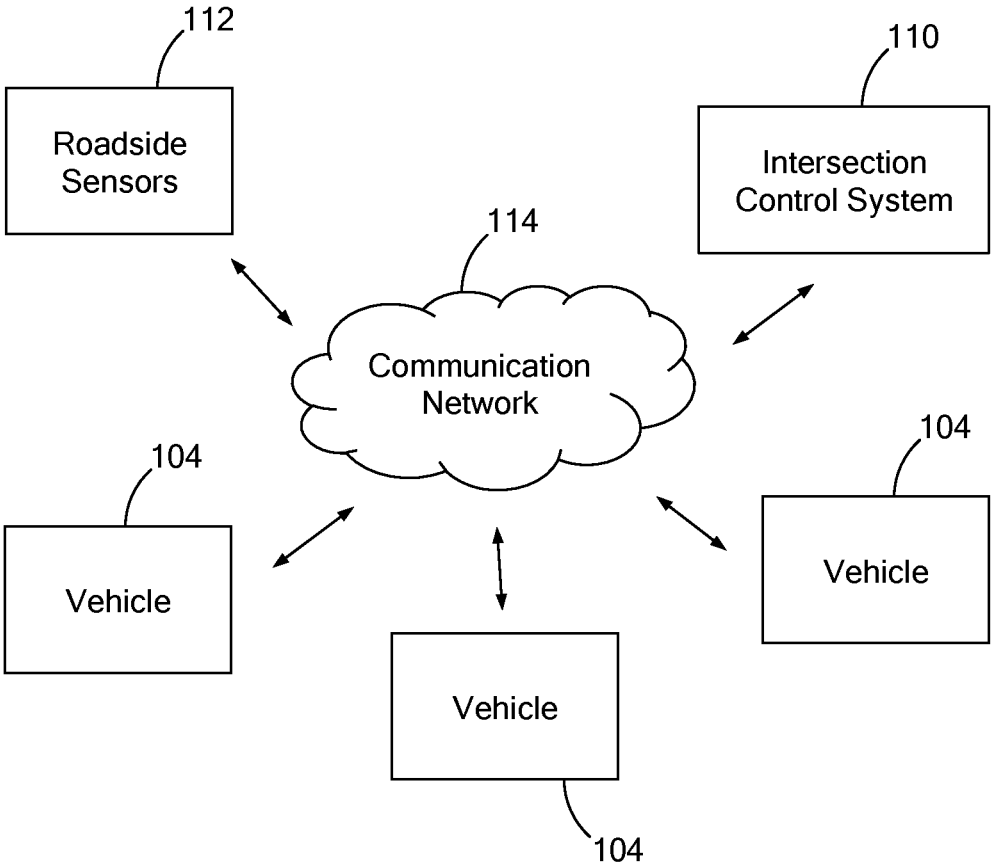
FIG. 2 is a block diagram of the system of FIG. 1.

FIGS. 1 and 2 illustrate an example system 100 in which a roundabout 102 is approached by vehicles 104-1 to 104-3 and traversed by vehicles 104-4 to 104-6 ("vehicles 104", collectively). The roundabout 102 has two lanes 106-1 and 106-2 and an island 108. In one form, the roundabout 102 includes an intersection control system 110 for determining or mapping dynamic traffic flow about the roundabout 102. The roundabout 102 may be configured in various suitable ways and should not be limited to the example provided herein. For example, the roundabout 102 may have one or more lanes, pedestrian cross-walks/islands, and bicycle lanes, among other characteristics. In the following, the phrase "about a roundabout/un-signalized intersection" may include vehicles at the roundabout, approaching the roundabout, exiting the roundabout, or generally, vehicles within a vicinity and at the roundabout. In addition, the phrase "about an entrance of the roundabout/un-signalized intersection" includes moving objects at or approaching an entrance of the roundabout/un-signalized intersection.

The system 100 may further include one or more roadside sensors 112 disposed at or around the roundabout 102 to monitor the environment about the roundabout 102. For example, FIG. 1 illustrates roadside sensors 112-1 and 112-2 ("roadside sensors 112", collectively) arranged at buildings or sites located about the roundabout 102. In one form, the sensors 112 are configured to detect and/or identify objects; determine position, speed, and/or direction of an identified object that may be stationary or moving; and/or detect weather conditions, such as precipitation, fog, and/or sun. Sensors performing such tasks may include, but are not limited to, cameras, radar, LIDAR, infrared sensors, ultrasonic sensors, and/or weather sensors (thermometer, barometer, and hygrometer, among others). While specific examples are provided, other types of data such as latency delays, may be detected to assist in determining or mapping a dynamic traffic flow of the roundabout 102.

The system 100 may also support device-to-device communication which incorporates vehicle-to-vehicle, vehicle-to-infrastructure, and vehicle-to-network, among other communication links by way of a communication network 114. In one form, the communication network 114 may encompass wireless computer network (e.g., dedicated short-range communication (DSRC)), cellular network (e.g., 3GPP and 5G), and/or satellite communication. Accordingly, the system 100 may include gateways, routers, base stations, satellites, edge or distributed computing, and intermediary communication devices, among other components to support the communication network 114.

Devices connected to the communication network 114 may exchange different type of information based on the type of device. As an example, a vehicle 104 connected to the network 114 (i.e., a connected vehicle) transmits a message that includes information to identify the connected vehicle, and characteristics of the vehicle 104 such as location (e.g., coordinates and/or elevation), speed, travel direction, acceleration, and/or brake system status. In one form, to improve bandwidth and reduce computational load, devices transmit selected data, such as a location, speed, and travel direction.

Figure 3:
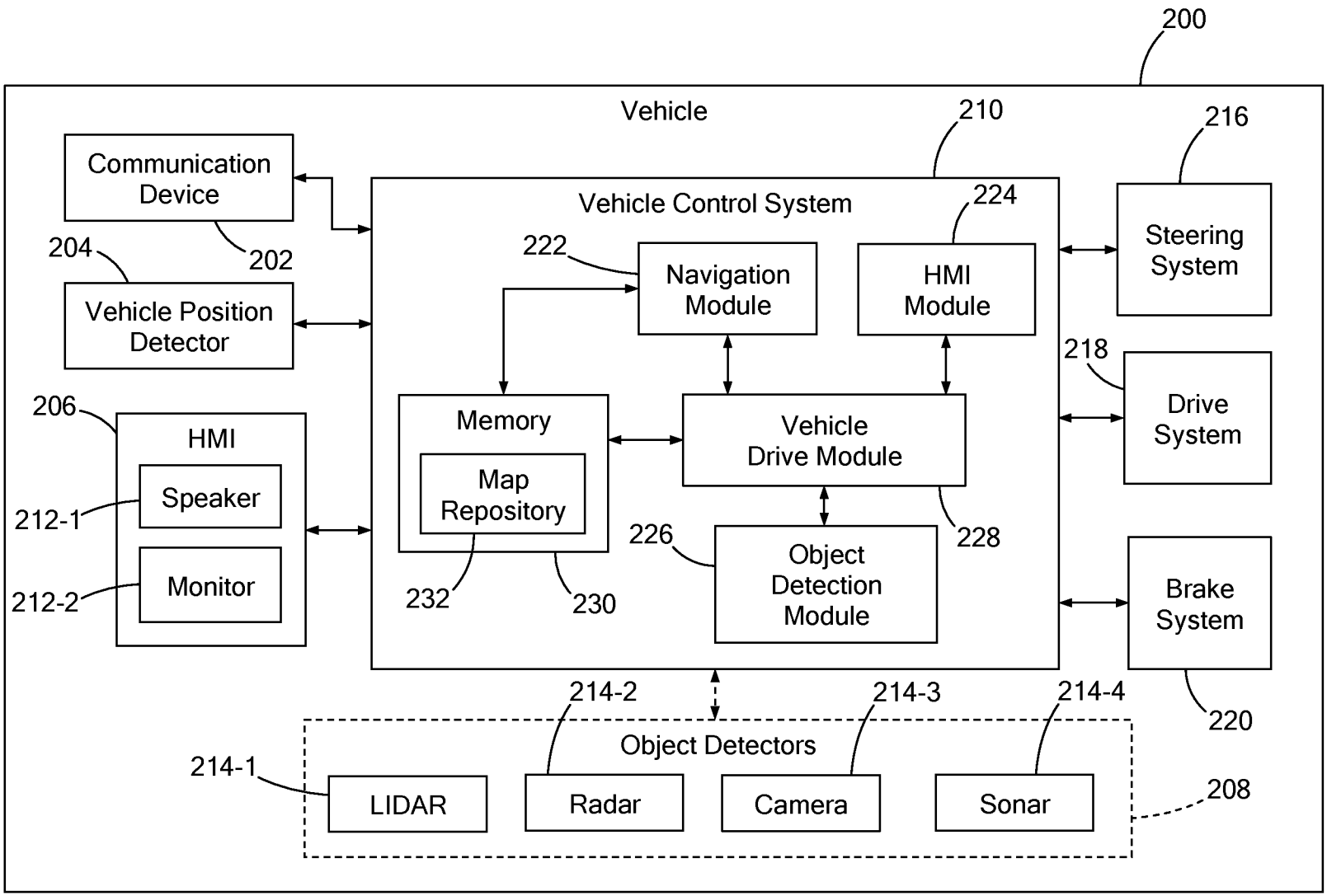
FIG. 3 is a block diagram of a vehicle in accordance with the teachings of the present disclosure.

The vehicles 104 may have the same or different levels of automation that include, for example, fully-autonomous, semi-autonomous (e.g., conditional automation and/or high automation), and/or manually operated (e.g., no automation, driver assistance, partial automation). Referring to FIG. 3, an example block diagram is provided of a vehicle 200 that is a manually operated vehicle with partial automation and is connected to the communication network 114. The vehicles 104 of FIG. 1 may be configured as vehicle 200.

In one form, the vehicle 200 includes a communication device 202, a vehicle position detector 204, a human machine interface (HMI) 206, one or more object detectors 208, and a vehicle control system 210. The communication device 202 is configured to exchange data with other devices in the system 100 via the communication network 114. In one form, the communication device 202 includes a transceiver (not shown) for connecting to the communication network 114 and a controller having memory and a microprocessor for processing messages received and generating messages to be transmitted. For example, the communication device 202 is configured to transmit a message to other devices that identifies the vehicle 200 and provides selected characteristics of the vehicle 200, such as position, speed, and travel direction. This message can be provided as a basic safety message (BSM) defined by SAE J2735 BSM type protocol or other suitable vehicle messaging protocol.

The vehicle position detector 204 is configured to determine the location of the vehicle 200 and may include a GPS antenna. In one form, the vehicle control system 210 utilizes the vehicle location, as part of a navigation module, to determine travel routes to a selected destination.

The HMI 206 is configured to provide information and/or entertainment and receive commands from a passenger. The HMI 206 is typically provided within a passenger cabin of the vehicle 200, and may include a speaker 212-1, a monitor 212-2 (e.g., liquid crystal display), and/or other devices such as touchscreen, buttons, microphone, and/or knobs (not shown).

The object detectors 208 are arranged about the vehicle 200 and are configured to detect objects about the vehicle 200, which include stationary and moving objects. For example, the object detectors 208 are operable to detect objects such as other vehicles, traffic markers (e.g., lane markings and signs, among others), pedestrians, vegetation, and road barriers, among others. In one form, the object detectors 208 may include a LIDAR 214-1, a radar 214-2, a camera 214-3, an ultrasonic sensor (i.e., sonar) 214-4, and/or a combination thereof. It should be readily understood that other suitable object detectors may also be used and should not be limited to the examples provided herein.

The vehicle control system 210 encompasses various controllers that are configured to control different sub-systems within the vehicle 200 such as, but not limited to, the HMI 206, a steering system 216, a drive system 218, and a brake system 220. The steering system 216 includes a series of components such as a steering wheel, steering angle sensors, and powered steering actuators, for moving the vehicle 200 based on a rotation of the steering wheel provided by a driver. The drive system 218 is configured to generate and deliver power to the wheels of the vehicle 200 to move the vehicle 200. Based on the type of vehicle 200, the drive system 218 includes components such as, but not limited to, engine, transmission, battery system, electric motors, wheels, suspension, converter/generator, actuators, and/or sensors for detecting speed/velocity, wheel angle, and vehicle heading. The brake system 220 is operable to slow the vehicle 200 based on an input from the driver (e.g., depression of a brake pedal). Based on the type of brake system (e.g., regenerative, hydraulic, etc.), the brake system 220 may include components such as, but not limited to pedal, brakes, discs, and/or brake controllers. While specific sub-systems are illustrated, the vehicle 200 may include other sub-systems.

In one form, the vehicle control system 210 includes a navigation module 222, an HMI module 224, an object detection module 226, a vehicle drive module 228, and a memory 230 for storing a map repository 232. The vehicle control system 210 may include one or more controllers that are configured as the modules 222, 224, 226, and 228. The one or more controllers may include a processor circuit, a memory circuit for storing code executed by the processor circuit, and other suitable hardware components to provide the described functionality of the modules 222, 224, 226, and 228. While specific modules are illustrated, the vehicle control system 210 may include other modules for controlling the vehicle 200 and should not be limited to the modules described herein.

The navigation module 222 is configured to track location of the vehicle 200 and determine travel routes to a destination based on the location of the vehicle 200 and maps provided in the map repository 232. In one form, the destination is provided by a user via the HMI 206, a software application associated with the vehicle 200, or other suitable method. In one form, the map repository 232 stores various navigational maps that illustrate roads, transit routes, points of interest, and other suitable information. The map repository 232 may also store characteristics of the road, such as road curvature, road height, intersection layout, roundabout characteristics, traffic direction (e.g., one-way travel, or two-way), and/or number of lanes along the road.

The HMI module 224 is configured to operate the devices of the HMI 206 to provide information to passengers of the vehicle 200. For example, the HMI module 224 outputs audio such as directions to a destination to passengers via the speaker 212-1 and visual messages such as travel route and vehicle speed, to passengers via the monitor 212-2.

The object detection module 226 is configured to detect objects about the vehicle 200 and determines dynamic characteristics of moving objects such as, but not limited to, the type of object detected, position, speed, distance, and/or trajectory. In one form, the object detection module 226 detects and/or identifies objects based on data from the object detectors 208. As an example, the object detectors 208 may emit a signal having predefined properties (e.g., frequency, waveform, amplitude, etc.), and receive a signal that is reflected off an object, such as an adjacent vehicle. The object detection module 226 is configured to analyze the signals transmitted and received to determine whether an object is present, and if so, determines one or more dynamic characteristics if the object is moving, which can be determined using multiple sets of transmitted and received signals.

In one form, the vehicle drive module 228 is configured to control various vehicle sub-systems to move the vehicle 200. In one form, the vehicle drive module 228 receives data from various sensors regarding an input from a driver such as rotation of a steering wheel detected by an steering angle sensor, actuation of the acceleration pedal detected by an accelerator pedal sensor, and/or actuation of a brake pedal detected by a brake pedal position sensor. Based on these inputs and prestored control programs, the vehicle drive module 228 transmits control signals to, for example, the drive system 218 to generate power via the engine or battery to move the vehicle to and/or to the brake system 220 to have the brakes reduce the speed of the vehicle. It should be readily understood that other driver inputs may be available for controlling the vehicle and are within the scope of the present disclosure. In addition, the vehicle drive module 228 may output other control signals to the systems 216, 218, and 220 and/or to other subsystems to control the drive operation of the vehicle 200 and should not be limited to the examples provided herein.

Furthermore, in one form, the vehicle drive module 228 may include different software applications for performing partial automated control. For example, the vehicle drive module 228 is configured to provide lane change assist for moving the vehicle 200 from a first drive lane to a second drive lane and/or a collision avoidance feature for inhibiting collision and/or reducing collision impact with an object.

Figure 4:
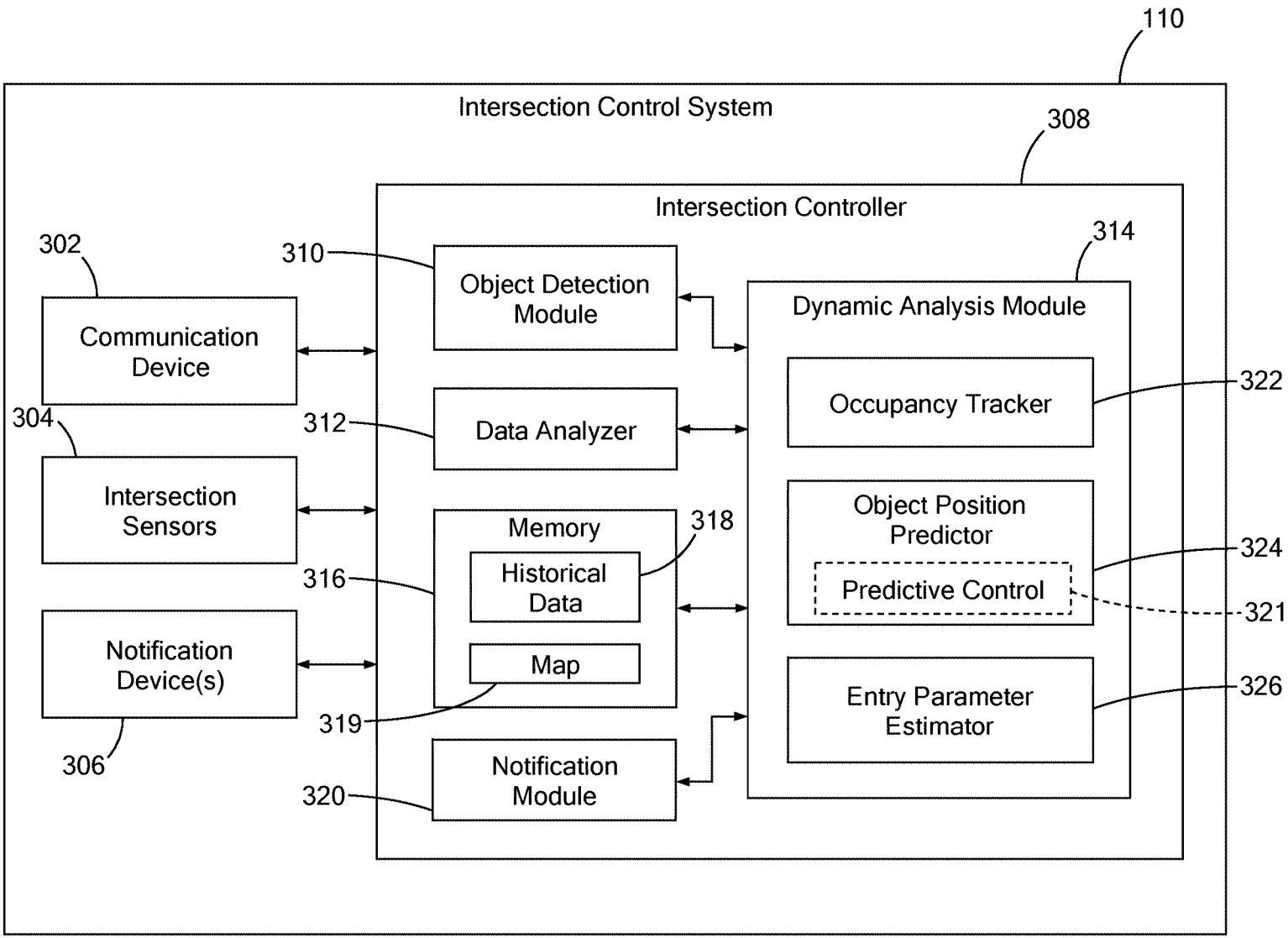
FIG. 4 is a block diagram of an intersection control system in accordance with the teachings of the present disclosure.

Referring to FIG. 4, the intersection control system 110 is configured to analyze dynamic traffic flow about the roundabout 102 and provide entry parameters a vehicle approaching or at an entrance of the roundabout 102. In one form, the intersection control system 110 includes a communication device 302, one or more intersection sensors 304, a notification device 306, and an intersection controller 308. The communication device 302 is configured to operate with other devices in the system 100 via the network 114 and, thus, may include a router and/or transceiver, among other components.

The intersection sensors 304 are configured to provide a full view of objects at the roundabout 102 and detect moving object(s) about the roundabout 102. In one form, the intersection sensors 304 are mounted at the roundabout 102 at a height sufficient to acquire a full view (i.e., 360 degrees) of the roundabout 102. The intersection sensors 304 may include cameras, radar, LIDAR, infrared sensors, ultrasonic sensors, and sensor arrays, among others. While illustrated, the intersection control system 110 may not include the intersection sensors 304 and may rely on data from roadside sensors 112 and/or vehicles 104.

The notification device 306 provides notifications to vehicle about the entrance of the roundabout 102. In one form, the notification device 306 is a digital signage such as a light emitting diode (LED)-type display or liquid crystal display (LCD), among others, that is operable to display a message/notification. In one form the notification device 306 is configured to be visible by vehicles approaching at an entrance and, thus, the roundabout 102 may include one or more notification devices 306.

The intersection controller 308 is configured to acquire data from different devices (e.g., the vehicles 104, the roadside sensors 112, the intersection sensors 304, etc.), and analyze the data in real time to generate an entry parameter such as vehicle speed, for a vehicle entering the roundabout 102. In one form, the intersection controller 308 is a computing device mounted at the roundabout 102. In another form, the intersection controller 308 is part of a cloud-based network comprising servers configured to store data and compute traffic characteristics, such as arterial traffic density and traffic flow, among other information. The intersection controller 308 is provided at the cloud edge in vicinity of the roundabout 102 to perform calculations related to the roundabout 102.

In one form, the intersection controller 308 includes an object detection module 310, a data analyzer 312, a dynamic analysis module 314, a memory 316 for storing historical data 318 and a map 319 of the intersection, and a notification module 320. The object detection module 310 acquires data from the intersection sensors 304 and is configured to identify moving objects about the roundabout 102 such as vehicles, and determine current dynamic characteristics of the moving objects, such as position, speed, and travel direction. The object detection module 310 is also configured to monitor entrances of the roundabout 102 to determine if a vehicle is approaching or at an entrance of the roundabout 102 and provide characteristics of the vehicle 104. For example, referring to FIG. 1, the object detection module 310 may identify vehicles 104-1, 104-2, and 104-3 as moving objects about to enter the roundabout 102. The object detection module 310 may also be configured to identify the entrance of the roundabout 102 that the vehicle is at. For example, in one form, the object detection module 310 includes information that correlates a detection area of each intersection sensor 304 with an area of the roundabout 102.

By way of the communication device 302, the intersection controller 308 receives different type of data indicative of characteristics of one or more moving objects such as a basic safety message from a vehicle. The data analyzer 312 is configured to process the data received and acquire current dynamic characteristics of one or more moving objects about the roundabout. The current dynamic characteristics of a moving object includes a current speed, a current travel direction, a current position, or a combination thereof. In one form, the data analyzer 312 recognizes data type, format, and structure of the raw data, and inputs the data with preprocessing unique to each data stream. The data is then processed into time-series and correlated to the raw data input stream.

Using the processed data, the dynamic analysis module 314 is configured to determine a current and a future dynamic traffic flow of the roundabout and estimate an entry parameter for a vehicle provided at an entrance of the roundabout 102. More particularly, the dynamic analysis module 314 is configured to perform a dynamic analysis of dynamic traffic flow of the roundabout 102 to determine an entry parameter for a vehicle at an entrance. In one form, the dynamic analysis module 314 is configured to have a deep neural network or, in other words, artificial intelligence to provide a predictive control 321 for predicting position, path, and/or other characteristics of moving objects about the roundabout 102 (e.g. moving objects approaching, traversing, and/or exiting the roundabout 102). In one form, the deep neural network is based on reinforcement learning using the historical data 318 provided in the memory 316 to train the neural network and derive the response policy and, in one form, is reinforcement learning in a Q- or Deep Q network (DQN). Q learning networks learn a policy to instruct the agent (in this case a vehicle) what action to take under specific circumstances. Q learning is not formula constrained and is, therefore, may be model free, which makes these types of reinforcement learning networks favorable for stochastic transitions. In one form, the artificial intelligence is agent based and capable of independent and collaborative analysis and traverse of the roundabout.

In one form, the dynamic analysis module 314 is configured to operate as an occupancy tracker 322, an object position predictor 324, and an entry parameter estimator 326. Using the map 319 in the memory 316 and the data from the data analyzer 312 and/or the object detection module 310, the occupancy tracker 322 determines a dynamic traffic flow of the roundabout 102 based on the current dynamic characteristics of the moving objects about the roundabout 102. For example, the occupancy tracker 322 maps the dynamic characteristics of each moving object with respect to the map 319 of the roundabout 102 to determine the dynamic traffic flow and the position of each moving object. In one form, this information may be provided to vehicles about the roundabout 102.

The object position predictor 324 predicts future dynamic characteristics of the moving objects based on the dynamic traffic flow and the predictive control 321. The future dynamic characteristics includes a predicted position of the moving object at a predefined time in the future, a predicted speed, a predicted travel direction, or a combination thereof. In one form, the predefined time is a prediction window and may be referred to as a "time horizon" or "planning horizon" which is a time increment where a high confidence level for the predicted movement of the host vehicle and/or neighboring vehicles is analyzed. A time horizon may be 1 second, 5 seconds, 10 seconds or any time interval where a sufficient confidence level for road user movement may be predicted.

The entry parameter estimator 326 is configured to calculate an entry parameter for a vehicle about an entrance of the roundabout 102 based on the dynamic traffic flow and the predicted future dynamic characteristics. In one form, the entry parameter estimator 326 estimates a traffic gap for having the vehicle enter the roundabout 102 and calculates, as the entry parameter, a recommended speed, recommended time for entering the roundabout, a lane level map, or a combination thereof. In one form, the traffic gap is determined based on the current and future positions of the moving objects about the roundabout 102. From among the different traffic gaps, the entry parameter estimator 326 selects a desired traffic gap that permits the vehicle to enter the roundabout 102 and calculates the recommended speed of the vehicle and recommended time of entry. In one form, the entry parameter estimator 326 determines the entry parameter for vehicles detected about any of the entrances of the roundabout.

In addition to or in lieu of the recommended speed of the vehicle and the recommended time of entry, the entry parameter may also include a lane level map that defines the path the vehicle should take for entering the roundabout 102. Generally, the lane used to enter and traverse the roundabout is contingent on the number of lanes in the roundabout and the exit point and the map of the roundabout may provide preferred traverse routes. Accordingly, in one form, the entry parameter estimator 326 defines a travel path of the vehicle to enter the roundabout 102 based on the map 319 of the roundabout 102 that has the preferred traverse routes, the position of the vehicle at the entrance, and/or the intended exit point of the vehicle which can be provided by the vehicle or predicted.

In one form, to further improve the accuracy of the future dynamic characteristics of the moving object, the intersection control system 110 may acquire ground truth data from probe vehicles that act as a reference data point. In another form, the intersection control system 110 may process the data received from external devices and/or the intersection sensors to remove anomalous data points.

The notification module 320 is configured to notify the vehicle about the entrance of the entry parameter determined by the entry parameter estimator 326. In one form, the notification module 320 generates and transmits a message to the vehicle about the entrance with the entry parameter. For example, using predefined communication protocols, the notification module 320 sends the entry parameter such as the recommended speed, in a message transmitted via the communication device and the network 114. In response to receiving the message, the vehicle notifies the driver of the entry parameter via the HMI such as an audio message or a graphical message displayed on a monitor. In addition to or in lieu of the message, the notification module 320 displays a notification that provides the entry parameters at the notification devices 306. Accordingly, vehicles that are connected to the network 114 and those that are not connected are provided an entry parameter. The notification module 320 may also provide a lane level map to the vehicle and/or the notification module 320 to highlight the recommended travel of the vehicle.

Figure 5:
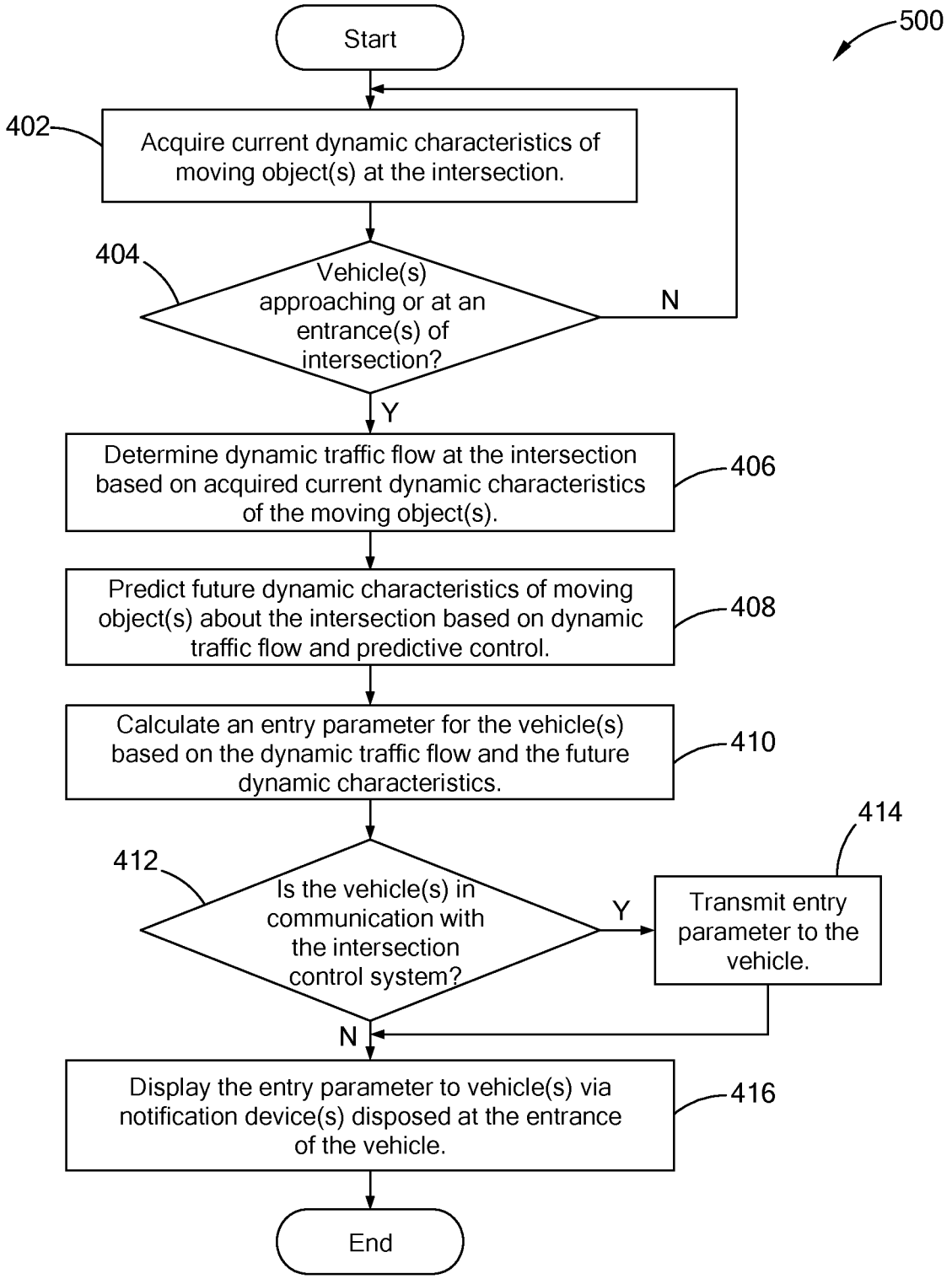
FIG. 5 is a flowchart of an intersection traffic control routine performed by the intersection control system in accordance with the teachings of the present disclosure.

Referring to FIG. 5, an example intersection traffic control routine 400 is performed by the intersection control system of the present disclosure to control traffic through an unsignalized intersection, such as a roundabout. At 402, the system acquires current dynamic characteristics of moving object(s) at the intersection. For example, in one form, the system receives data indicative of characteristics of one or more moving objects at the intersection from external devices such as roadside sensors and/or vehicles in communication with the system via a communication network. In one form, the vehicle may transmit data indicative of the position, speed, and/or travel direction of the vehicle and the roadside sensors may transmit characteristics of moving objects such as pedestrians and vehicles not in communication with the system. The data may also include characteristics of moving objects detected by the intersection sensors. From the characteristics, the system obtains the current dynamic characteristics of each moving object which includes, for example, a current speed, a current travel direction, a current position, or a combination thereof.

At 404, the system determines whether a vehicle is approaching or is at an entrance of the intersection. In one form, the intersection sensors monitor each entrance of the intersection to determine if a vehicle is about the entrance. The sensors may detect more than one vehicle for a given entrance.

If a vehicle is about the entrance, the system determines the dynamic traffic flow of the roundabout based on the current dynamic characteristics of the moving object(s), at 406. At 408, the system predicts future dynamic characteristics of moving object(s) about the intersection based on dynamic traffic flow and predictive control, as provided above. The future dynamic characteristics includes a predicted position, a predicted speed, a predicted travel direction, or a combination thereof. At 410, the system calculates an entry parameter for the vehicle(s) based on the dynamic traffic flow and the future dynamic characteristics. For example, the system calculates a travel gap between moving objects at the intersection, such as vehicles traversing the roundabout, and identifies a travel gap within which the vehicle may enter the intersection. Based on the travel gap and current speed of the vehicle, the system determines entry parameters for the vehicle which may include a recommended speed of the vehicle, a recommended time for entering the un-signalized intersection, a lane level map, or a combination thereof.

Figure 6A:
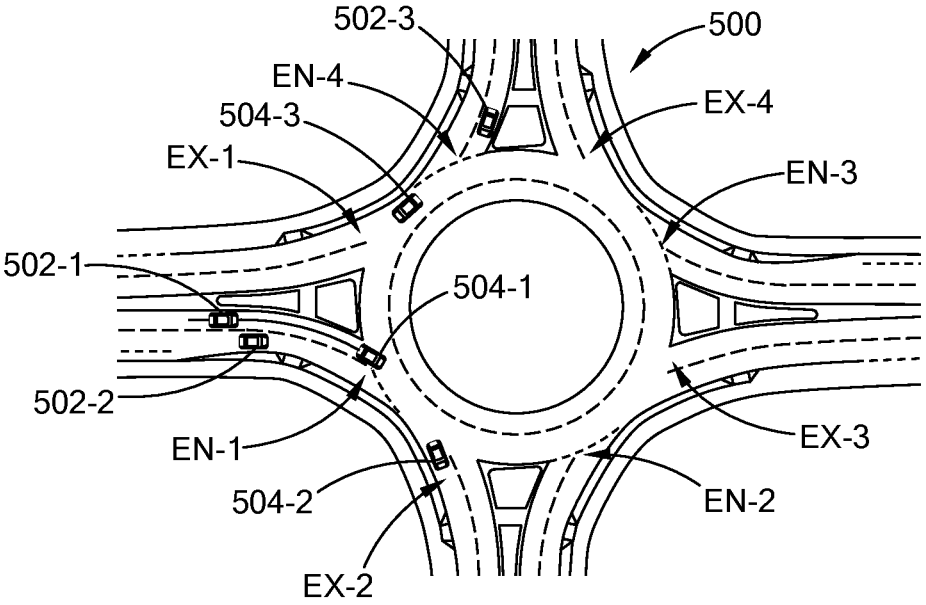
FIGS. 6A and 6B illustrate a roundabout with multiple vehicles traversing through the roundabout in accordance with the teachings of the present disclosure.

In an example, FIG. 6A illustrates a roundabout 500 that is a two-lane roundabout with entry points EN-1, EN-2, EN-3, and EN-4, and exit points EX-1, EX-2, EX-3, and EX-4. Vehicles 502-1, 502-2, and 502-3 ("vehicle 502," collectively) are approaching or are at an entrance of the roundabout 500, and vehicles 504-1, 504-2, and 504-3 ("vehicle 504," collectively) are traversing the roundabout 500. Based on the current dynamic characteristics of the vehicles, the system is able to determine or map the dynamic traffic flow of the roundabout. That is, the system knows the current speed, position, and/or travel direction of the vehicles.

Figure 6B:
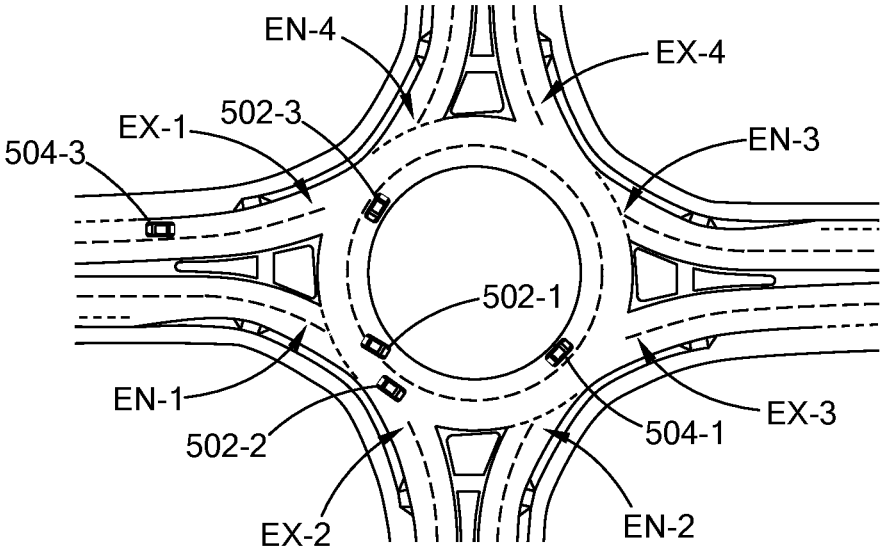

Using the predictive control, the system predicts the future dynamic characteristics of each vehicle. For example, FIG. 6B, illustrates future positions of some of the vehicles 502 and 504. Vehicle 504-2 is not illustrated because it exited the roundabout via EX-2. Using the future positions, travel directions, and/or speeds, the system can determine entry parameters for each vehicle 502. For example, vehicles 502-1 and 502-3 are predicted to travel the inner lane of the roundabout 500 and vehicle 502-2 is predicted to travel the outer lane of the roundabout. The travel gap between vehicles 502-3 and 502-1 is one factor for permitting vehicle 502-1 to enter the roundabout 500. Since vehicle 502-3 is also in position to enter the roundabout 500, the system can control the travel gap between vehicles 502-1 and 502-3 by having vehicle 502-3 enter the roundabout at a reduced speed and/or at time that allows the vehicle 502-1 to enter the roundabout between vehicles 502-2 and 502-3. The system may then determine the recommended speed, recommended time, and/or lane level map for the vehicles 502.

Figure 7A:
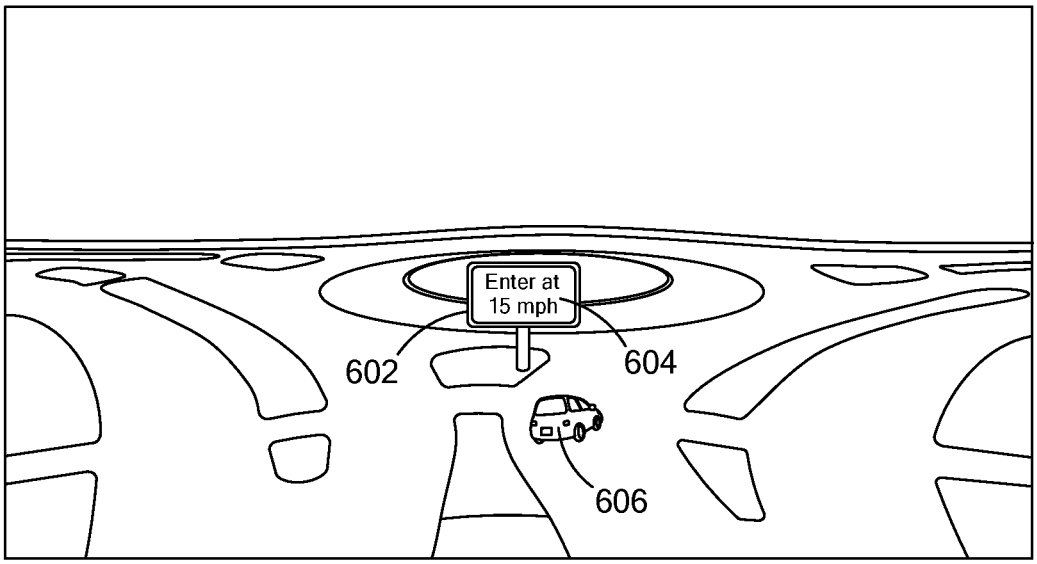
FIGS. 7A and 7B illustrate an entry parameter provided by a notification device at a roundabout and by a monitor for a vehicle in accordance with the teachings of the present disclosure.
Figure 7B:
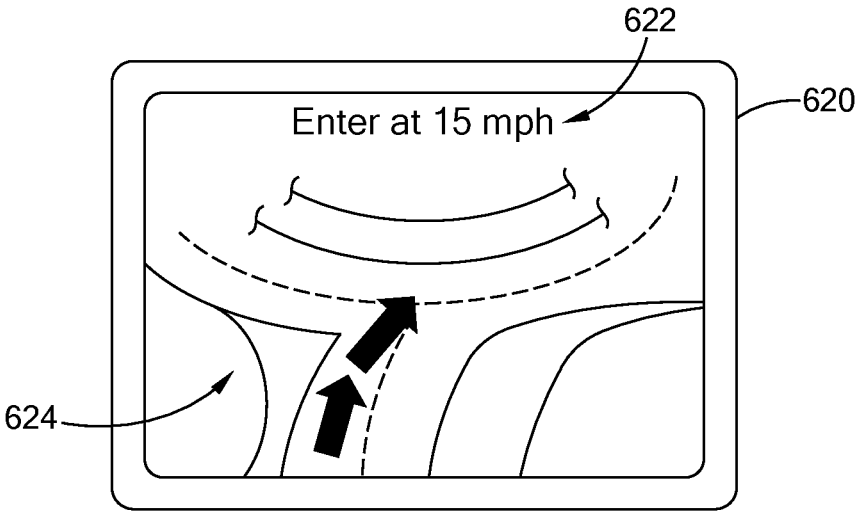

At 412, the system determines if the vehicle is in communication with the intersection control system. If so, the system notifies the vehicle of the entry parameter by transmitting a message with the entry parameter to the vehicle, at 414. In response to receiving the message, the vehicle provides a notification to a driver of the vehicle of the entry parameter via the HMI. If the vehicle is a fully-autonomous vehicle, the vehicle control system controls one or more vehicle sub-systems to have the vehicle enter the intersection in accordance with the entry parameter. If the vehicle is not in communication or after the entry parameter is transmitted, the system displays the entry parameter to the vehicle about the entrance via a notification device disposed at the entrance, at 416. For example, FIG. 7A illustrates a roundabout 600 having a notification device 602, that displays an entry parameter 604 provided as a recommended speed to a vehicle 606 at an entrance of the roundabout, and FIG. 7B illustrates a monitor 620 to be provided in a vehicle as part of an HMI. The monitor 620 depicts an entry parameter provided as a recommended speed 622 and a lane level map 624 for a driver. The system may continuously perform this routine to regulate the traffic at the intersection. It should be readily understood that the routine 400 is just one example implementation of an intersection traffic control routine, and other control routines may be implemented.

Based on the foregoing, the following provides a general overview of the present disclosure and is not a comprehensive summary.

In one form, the present disclosure is directed toward a method that includes: acquiring current dynamic characteristics of a moving object about an un-signalized intersection; determining a dynamic traffic flow of the un-signalized intersection based on the current dynamic characteristics; predicting future dynamic characteristics of the moving object based on the dynamic traffic flow and a predictive control, where the future dynamic characteristics includes predicted characteristics of the moving object at a predefined time in the future; calculating an entry parameter for a vehicle about an entrance of the un-signalized intersection based on the dynamic traffic flow, the predicted future dynamic characteristics; and notifying the vehicle of the entry parameter.

In another form, the acquiring the current dynamic characteristics further includes receiving data indicative of characteristics of the moving object and determining the current dynamic characteristics of the moving object based on the received data. The current dynamic characteristics of the moving object includes a current speed, a current travel direction, a current position, or a combination thereof.

In yet another form, the future dynamic characteristics for the moving object includes a predicted speed, a predicted travel direction, a predicted position, or a combination thereof.

In one form, the current dynamic characteristics for the moving object include a current speed, a current travel direction, a current position, or a combination thereof.

In yet another form, the predictive control is based on a trained artificial neural network.

In one form, the notifying the vehicle of the entry parameter further includes: generating and transmitting a message to the vehicle, where the message provides the entry parameter for the vehicle; displaying a notification at a notification interface disposed at the un-signalized intersection, wherein the notification provides the entry parameter for the vehicle; or a combination thereof. The entry parameter includes a recommended speed of the vehicle, a recommended time for entering the un-signalized intersection, a lane level map, or a combination thereof.

In another form, the method further includes: estimating a traffic gap for having the vehicle about the entrance enter the un-signalized intersection based on the dynamic traffic flow and the future dynamic characteristics of the moving object; and calculating, for the vehicle about the entrance of the un-signalized intersection, a recommended speed, a recommended time for entering the un-signalized intersection, a lane level map, or a combination thereof based on the traffic gap and the future dynamic characteristics.

In one form, the present disclosure is directed toward an intersection control system that includes a controller configured to: acquire current dynamic characteristics of a moving object about an un-signalized intersection; determine a dynamic traffic flow of the un-signalized intersection based on the current dynamic characteristics; predict future dynamic characteristics of the moving object based on the dynamic traffic flow and a predictive control, where the future dynamic characteristics includes predicted characteristics of the moving object at a predefined time in the future; calculate an entry parameter for a vehicle about an entrance of the un-signalized intersection based on the dynamic traffic flow and the future dynamic characteristics; and notify the vehicle of the entry parameter.

In another form, the controller is further configured to receive data indicative of characteristics of the moving object, and determine the current dynamic characteristics of the moving object based on the data received. The current dynamic characteristics of the moving object includes a current speed, a current travel direction, a current position, or a combination thereof. In one variation, the intersection control system further includes an intersection sensor configured to detect the moving object and determine characteristics of the moving object. In another variation, the intersection control system further includes a communication device configured to exchange signals with an external device, and the communication device receives the data indicative of characteristics of the moving object from the external device.

In yet another form, the controller is configured to: generate and transmit a message that provides the entry parameter to the vehicle, display a notification at a notification interface disposed at the un-signalized intersection, or a combination thereof. The notification provides the entry parameter for the vehicle and the entry parameter includes a recommended speed of the vehicle, a recommended time for entering the un-signalized intersection, a lane level map, or a combination thereof.

In one form, the controller is configured to: estimate a traffic gap for having the vehicle about the entrance enter the un-signalized intersection based on the dynamic traffic flow and the future dynamic characteristics of the moving object, and calculate, for the vehicle about the entrance of the un-signalized intersection, a recommended speed, a recommended time for entering the un-signalized intersection, a lane level map, or a combination thereof based on the traffic gap and the future dynamic characteristics.

In one form, the present disclosure is directed toward an intersection control system that includes a plurality of intersection sensors configured to monitor environment about an un-signalized intersection, a communication device configured to exchange data with external devices and received data indicative of characteristics of a moving object, and a controller. The controller is configured to: acquire current dynamic characteristics of the moving object about the un-signalized intersection based on the received data, where the current dynamic characteristics includes a current position, a current speed, a current direction, or a combination thereof of the moving object; determine a dynamic traffic flow of the un-signalized intersection based on the current dynamic characteristics; predict future dynamic characteristics of the moving object based on the dynamic traffic flow and a predictive control, where the future dynamic characteristics includes a predicted speed, a predicted travel direction, a predicted position, or a combination thereof of the moving object at a predefined time in the future; calculate an entry parameter for a vehicle about an entrance of the un-signalized intersection based on the dynamic traffic flow and the future dynamic characteristics; and notify the vehicle of the entry parameter.

In another form, the intersection control system further includes a notification device disposed at the un-signalized intersection. The controller is configured to: generate and transmit a message that provides the entry parameter to the vehicle, display a notification at the notification interface disposed at the un-signalized intersection, or a combination thereof. The notification provides the entry parameter for the vehicle, and the entry parameter includes a recommended speed of the vehicle, a recommended time for entering the un-signalized intersection, a lane level map, or a combination thereof.

In yet another form, the controller is configured to: estimate a traffic gap for having the vehicle about the entrance enter the un-signalized intersection based on the dynamic traffic flow and the future dynamic characteristics of the moving object, and calculate, for the vehicle about the entrance of the un-signalized intersection, a recommended speed, a recommended time for entering the un-signalized intersection, a lane level map, or a combination thereof based on the traffic gap and the future dynamic characteristics.

In one form, the present disclosure is directed toward a system that includes the intersection control system described herein and a vehicle is configured to communicate with the intersection control system when it is about the un-signalized intersection. The intersection control system is configured to generate and transmit a message that provides the entry parameter for the vehicle in response to the vehicle being about the entrance of the un-signalized intersection.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, manufacturing technology, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

In the figures, the direction of an arrow, as indicated by the arrowhead, generally demonstrates the flow of information (such as data or instructions) that is of interest to the illustration. For example, when element A and element B exchange a variety of information, but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

The apparatuses and methods described in this application may be partially or fully implemented by a special purpose computer created by configuring a general-purpose computer to execute one or more particular functions embodied in computer programs.

The term memory is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

What is claimed is:

1. A method comprising:

acquiring, by an intersection control system, current dynamic characteristics of a moving object about an un-signalized intersection associated with the intersection controller;

determining, by the intersection control system, a dynamic traffic flow of the un-signalized intersection based on the current dynamic characteristics;

predicting, by the intersection control system, future dynamic characteristics of the moving object based on the dynamic traffic flow and a predictive control, wherein the future dynamic characteristics includes predicted characteristics of the moving object at a predefined time in the future;

calculating, by the intersection control system, an entry parameter for a vehicle about an entrance of the un-signalized intersection based on the dynamic traffic flow, the predicted future dynamic characteristics; and notifying, by the intersection control system via a notification device, the vehicle of the entry parameter to direct the vehicle about the un-signalized intersection, wherein the intersection control system includes the notification device that is located and secured at the entrance of the un-signalized intersection.

2. The method of claim 1, wherein the acquiring the current dynamic characteristics further comprises:

receiving, by the intersection control system, data indicative of characteristics of the moving object; and determining, by the intersection control system, the current dynamic characteristics of the moving object based on the received data, wherein the current dynamic characteristics of the moving object include a current speed, a current travel direction, a current position, or a combination thereof.

3. The method of claim 1, wherein the future dynamic characteristics for the moving object includes a predicted speed, a predicted travel direction, a predicted position, or a combination thereof.

4. The method of claim 1, wherein the current dynamic characteristics for the moving object include a current speed, a current travel direction, a current position, or a combination thereof.

5. The method of claim 1, wherein the predictive control is based on a trained artificial neural network.

6. The method of claim 1, wherein the notifying the vehicle of the entry parameter further comprises generating and transmitting a message to the vehicle, wherein the message provides the entry parameter for the vehicle.

7. The method of claim 1 further comprising:

estimating, by the intersection control system, a traffic gap for having the vehicle about the entrance enter the un-signalized intersection based on the dynamic traffic flow and the future dynamic characteristics of the moving object; and calculating, by the intersection control system, for the vehicle about the entrance of the un-signalized intersection, a recommended speed, a recommended time for entering the un-signalized intersection, a lane level map, or a combination thereof based on the traffic gap and the future dynamic characteristics.

8. An intersection control system comprising:

a controller configured to:

acquire current dynamic characteristics of a moving object about an un-signalized intersection;

determine a dynamic traffic flow of the un-signalized intersection based on the current dynamic characteristics;

predict future dynamic characteristics of the moving object based on the dynamic traffic flow and a predictive control, wherein the future dynamic characteristics includes predicted characteristics of the moving object at a predefined time in the future;

calculate an entry parameter for a vehicle about an entrance of the un-signalized intersection based on the dynamic traffic flow and the future dynamic characteristics; and notify, via a notification device, the vehicle of the entry parameter to direct the vehicle about the un-signalized intersection, wherein the notification device is located and secured at the entrance of the un-signalized intersection.

9. The intersection control system of claim 8, wherein the controller is further configured to receive data indicative of characteristics of the moving object, and determine the current dynamic characteristics of the moving object based on the data received, wherein the current dynamic characteristics of the moving object includes a current speed, a current travel direction, a current position, or a combination thereof.

10. The intersection control system of claim 9 further comprising an intersection sensor configured to detect the moving object and determine characteristics of the moving object.

11. The intersection control system of claim 9 further comprising a communication device configured to exchange signals with an external device, wherein the communication device receives the data indicative of characteristics of the moving object from the external device.

12. The intersection control system of claim 8, wherein the current dynamic characteristics for the moving object include a current speed, a current travel direction, a current position, or a combination thereof, and the future dynamic characteristics for the moving object includes a predicted speed, a predicted travel direction, a predicted position, or a combination thereof.

13. The intersection control system of claim 8, wherein the predictive control is based on a trained artificial neural network.

14. The intersection control system of claim 8, wherein the controller is configured to generate and transmit a message that provides the entry parameter to the vehicle.

15. The intersection control system of claim 8, wherein the controller is configured to:

estimate a traffic gap for having the vehicle about the entrance enter the un-signalized intersection based on the dynamic traffic flow and the future dynamic characteristics of the moving object, and calculate, for the vehicle about the entrance of the un-signalized intersection, a recommended speed, a recommended time for entering the un-signalized intersection, a lane level map, or a combination thereof based on the traffic gap and the future dynamic characteristics.

16. An intersection control system comprising:

a plurality of intersection sensors configured to monitor environment about an un-signalized intersection;

a communication device configured to exchange data with external devices and received data indicative of characteristics of a moving object;

a controller configured to:

acquire current dynamic characteristics of the moving object about the un-signalized intersection based on the received data, wherein the current dynamic characteristics includes a current position, a current speed, a current direction, or a combination thereof of the moving object;

determine a dynamic traffic flow of the un-signalized intersection based on the current dynamic characteristics;

predict future dynamic characteristics of the moving object based on the dynamic traffic flow and a predictive control, wherein the future dynamic characteristics includes a predicted speed, a predicted travel direction, a predicted position, or a combination thereof of the moving object at a predefined time in the future;

calculate an entry parameter for a vehicle about an entrance of the un-signalized intersection based on the dynamic traffic flow and the future dynamic characteristics; and notify, via a notification device, the vehicle of the entry parameter to direct the vehicle about the un-signalized intersection, wherein the notification device is located and secured at the entrance of the un-signalized intersection.

17. The intersection control system of claim 16, wherein the predictive control is based on a trained artificial neural network.

18. The intersection control system of claim 16, wherein the controller is configured to generate and transmit a message that provides the entry parameter to the vehicle.

19. The intersection control system of claim 16, wherein the controller is configured to:

estimate a traffic gap for having the vehicle about the entrance enter the un-signalized intersection based on the dynamic traffic flow and the future dynamic characteristics of the moving object, and calculate, for the vehicle about the entrance of the un-signalized intersection, a recommended speed, a recommended time for entering the un-signalized intersection, a lane level map, or a combination thereof based on the traffic gap and the future dynamic characteristics.

20. A system comprising:

the intersection control system of claim 16; and a vehicle is configured to communicate with the intersection control system when it is about the un-signalized intersection, wherein the intersection control system is configured to generate and transmit a message that provides the entry parameter for the vehicle in response to the vehicle being about the entrance of the un-signalized intersection.

* * * * *